US008118053B2

(12) United States Patent
Koran

(10) Patent No.: US 8,118,053 B2
(45) Date of Patent: Feb. 21, 2012

(54) ADJUSTABLE BACKFLOW PREVENTION DEVICE

(75) Inventor: Thomas Charles Koran, Warba, MN (US)

(73) Assignee: Thomas Charles Koran, Warba, MN (US)

( * ) Notice: Subject to any disclaimer, the term of this patent is extended or adjusted under 35 U.S.C. 154(b) by 490 days.

(21) Appl. No.: 12/481,344

(22) Filed: Jun. 9, 2009

(65) Prior Publication Data

US 2009/0301566 A1 Dec. 10, 2009

Related U.S. Application Data

(60) Provisional application No. 61/059,915, filed on Jun. 9, 2008.

(51) Int. Cl.
*E03C 1/12* (2006.01)

(52) U.S. Cl. ..... 137/216

(58) Field of Classification Search ..... 137/312, 137/313, 602, 215, 216; 141/332, 364, 365, 141/340

See application file for complete search history.

(56) References Cited

U.S. PATENT DOCUMENTS 5,860,444 A * 1/1999 Guendjoian et al. ..... 137/216

* cited by examiner

*Primary Examiner* — Craig Schneider

(74) *Attorney, Agent, or Firm* — Patterson Thuente Christensen Pedersen, P.A.

(57) ABSTRACT

A backflow prevention device is to be installed between various equipment drain lines and a drain cover or drain pipe. The backflow prevention device provides an air gap operable to prevent backflow of sewer waste into the drain lines. The device includes a drainage hub and a tubing mount attached to the drainage hub. The drainage hub defines a liquid flow conduit throw which liquid discharged from the drain lines can flow and can be connected to the drain. The tubing mount supports the drain lines in such a way that the drain line effluent is positioned to be in fluid connectivity with the upper opening of the liquid flow conduit at a vertically displaced position from the drainage hub.

16 Claims, 4 Drawing Sheets

ADJUSTABLE BACKFLOW PREVENTION DEVICE

PRIORITY CLAIM

The present application claims priority to U.S. Provisional Application Ser. No. 61/059,915, filed Jun. 9, 2008 and entitled "ADJUSTABLE AIR GAP BACKFLOW PREVENTION DEVICE AND DRAIN ADAPTER", which is herein incorporated by reference in its entirety.

FIELD OF INVENTION

The present invention relates generally to backflow prevention devices and, more particularly, to a plumbing fixture for attachment to a sewer connection or drain and that receives one or more appliance or equipment drain lines for preventing backflow by interposing an air gap in between.

BACKGROUND OF INVENTION

There is an inherent danger in connecting the drain lines of equipment and appliances directly to a building's main drain or sewer pipe. This is because the potential of backflow of sewer fluids through the drain lines into the equipment or appliances can contaminate the equipment or, worse, allow entry of the sewer into the public water supply. Such backflow can be caused by an unexpected increase in liquid pressure in the sewer system or an unexpected decrease of the liquid pressure in the drain line. For this reason, many state and local governments have established codes that must be complied with before an equipment drain can be connected to the sewer system. Such codes typically require that an air gap be established between each equipment drain line and the sewer system to prevent backflow. This air gap creates an indirect drain line between the equipment or appliance and the main sewer line. The discharge line must dispose of its liquid waste by discharging into a plumbing fixture which itself is connected to the building drainage system. The plumbing fixture most generally provides an air gap between the equipment or appliance drain line and the drain standpipe, grid or hub which is connected to the building drainage or public sewer system.

The prior art includes devices to provide the needed air gap and/or prevent backflow. Much of the prior art consists of complicated devices employing valves with moving parts, or baffled chambers requiring machined parts. Some simpler air gap devices have entered the field such as the device disclosed in U.S. Pat. No. 5,860,444. These simple devices fail to meet the needs of many supermarkets, vending companies and restaurants, and homeowners, however, who require the ability to discharge multiple lines in a cost and space efficient manner as well as providing flexibility in how the fixture is attached to the building drain system. In addition, these simple devices still require use of a specifically sized device for each drain line.

SUMMARY OF INVENTION

An adjustable backflow prevention device can be installed between various equipment drain lines and a drain cover or drain pipe. The backflow prevention device provides an air gap operable to prevent backflow of sewer waste into the equipment lines. The device includes a drainage hub and tubing mount. The drainage hub can have an upper funnel portion and lower pipe portion that define a liquid flow conduit running therethrough. The funnel upper edge can have a flange with a rim defining an upwardly facing mounting surface. The tubing mount or bracket can attach to the drainage hub at the mounting surface. The tubing mount can have a mount base and a mount cap that define a plurality of drain line mounting slots. The mount base and mount cap can be connected with threaded members to define a clamp mechanism for securing the drain lines. The mount can have a plurality of drain line receiving slots that allow attachment of different size discharge tubing lines. The mount can be adjustably attachable at multiple positions around the rim by a series of holes along the flange. A singe tube mount or a plurality of mounts can be attached to the flange. The drainage hub can be sized for direct bonding to a standard drain pipe. Alternatively, a J-shaped hook that can be attached to a central boss supported in the flow conduit by cross supports can be used to attach the back flow device to a drain grid. The tubing mount supports the drain lines in such a way that the drain line effluent is positioned to be in fluid connectivity with the upper opening of the liquid flow conduit.

It is a feature and advantage of certain embodiments of the present invention to provide a backflow prevention device which is simple, compact and easy to install.

It is a feature and advantage of certain embodiments of the present invention that the same backflow prevention device may be used for multiple sizes and types of drain lines.

It is further a feature and advantage of certain embodiments of the present invention that a single backflow prevention device may be used for multiple drain lines at one time.

It is a further feature and advantage of certain embodiments of the invention that it can be directly attachable to a drain grid or cover.

It is also a feature and advantage of certain embodiments of the invention that it is attachable to a standard standpipe, and easily adaptable to attachment to any size standpipe with standard pipe fittings. Moreover, certain embodiments provide for both the direct attachment to a drain grid or cover as well as providing an internal diameter for connection to the end and exterior of standard plumbing PVC pipe. Thus, flexibility is offered by a single device in how the fixture may be attached to the building drain system.

It is a feature and advantage that splash control is provided in the fixture. In certain embodiments a boss that is utilized for attachment of a j-shaped hook for securement to drain grids or covers is centrally supported by flutes or webbing within the fixture. The flutes or webbing also effectively provide splash control as well as a barrier to external objects entering the fixture and the connecting drain.

It is a further feature and advantage that a tubing mount provides a simple clamping mechanism for securing multiple drain lines. Moreover, the tubing mount may be chordally mounted positioning a plurality of parallel discharge lines aligned with a diameter of the funnel portion. Moreover, the tubing mount may have other shapes such as arcuate to follow the shape of the flange or may be circular with one or more drain overflow passageways. The tubing mount may be adjustable around the entire periphery of the flange of the funnel portion of the fixture. Moreover, multiple tubing mounts can be mounted to the top flange of the funnel providing multiple attachment sites and accommodating lines from different directions.

DETAILED DESCRIPTION OF THE DRAWINGS

Figure 1:
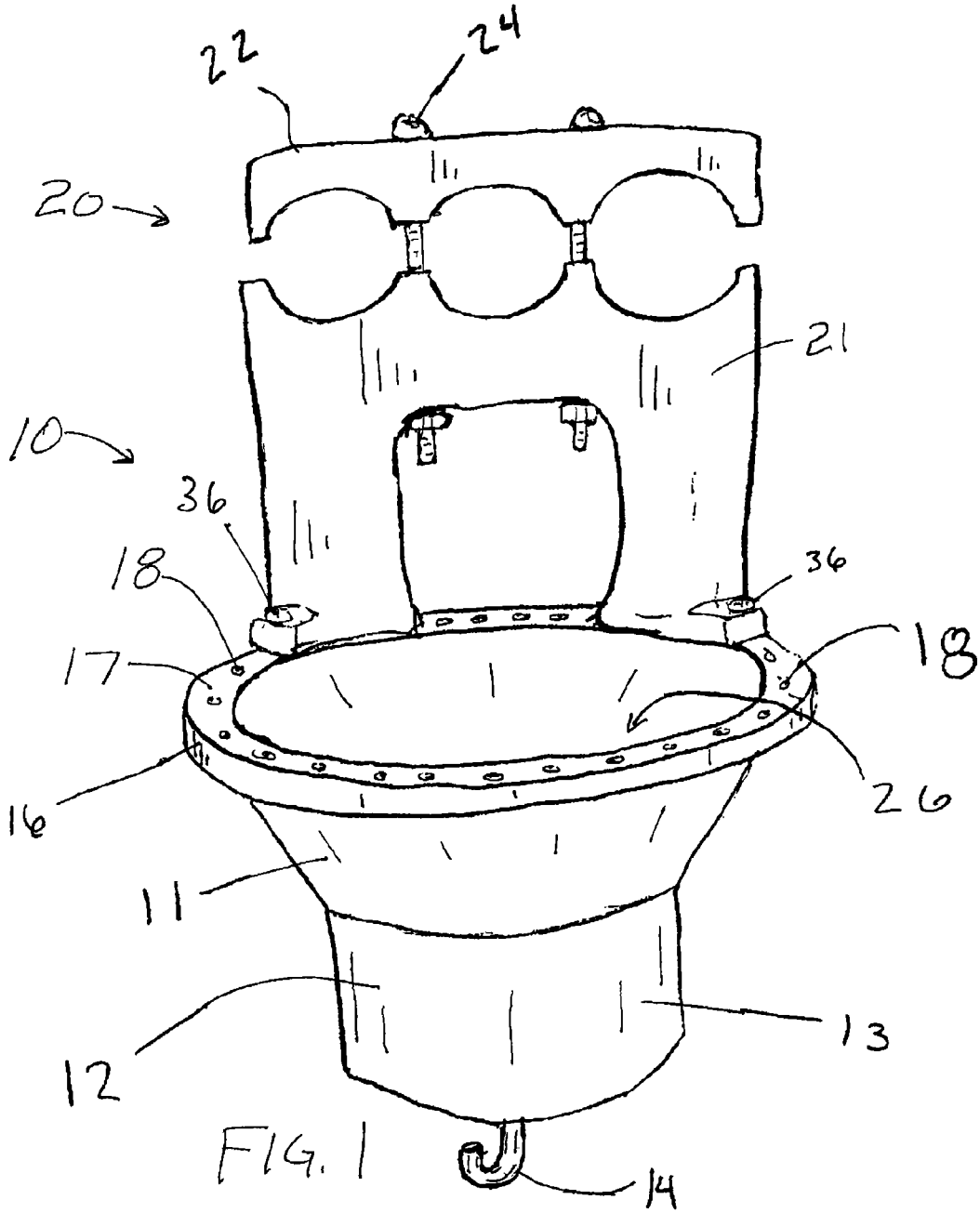
FIG. 1 is a perspective view of a backflow prevention device according to an embodiment of the present invention.
Figure 2:
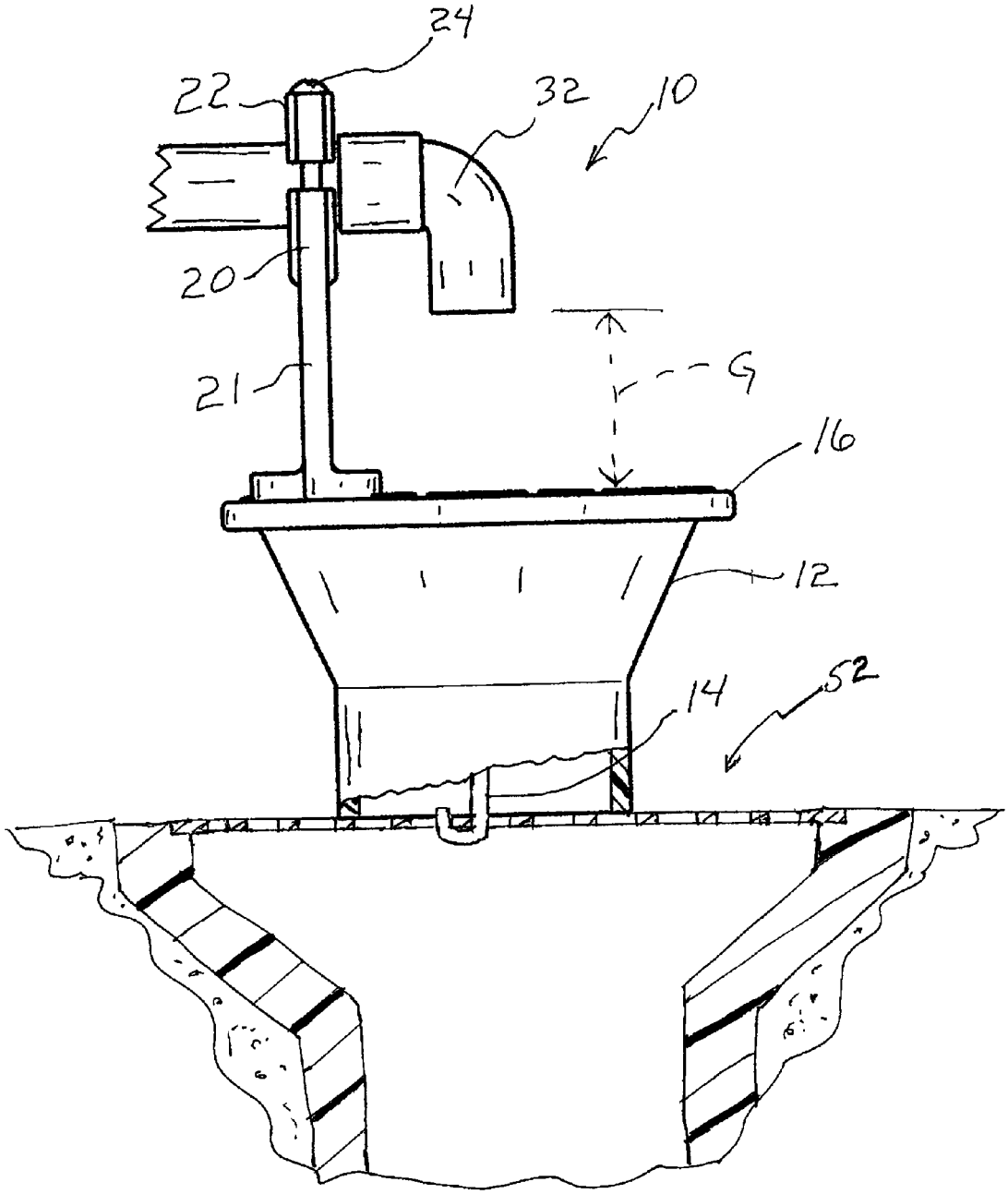
FIG. 2 is a side elevational view a backflow prevention device according to an embodiment of the present invention with a partial cross-section showing the invention attached to a drain grating.
Figure 3:
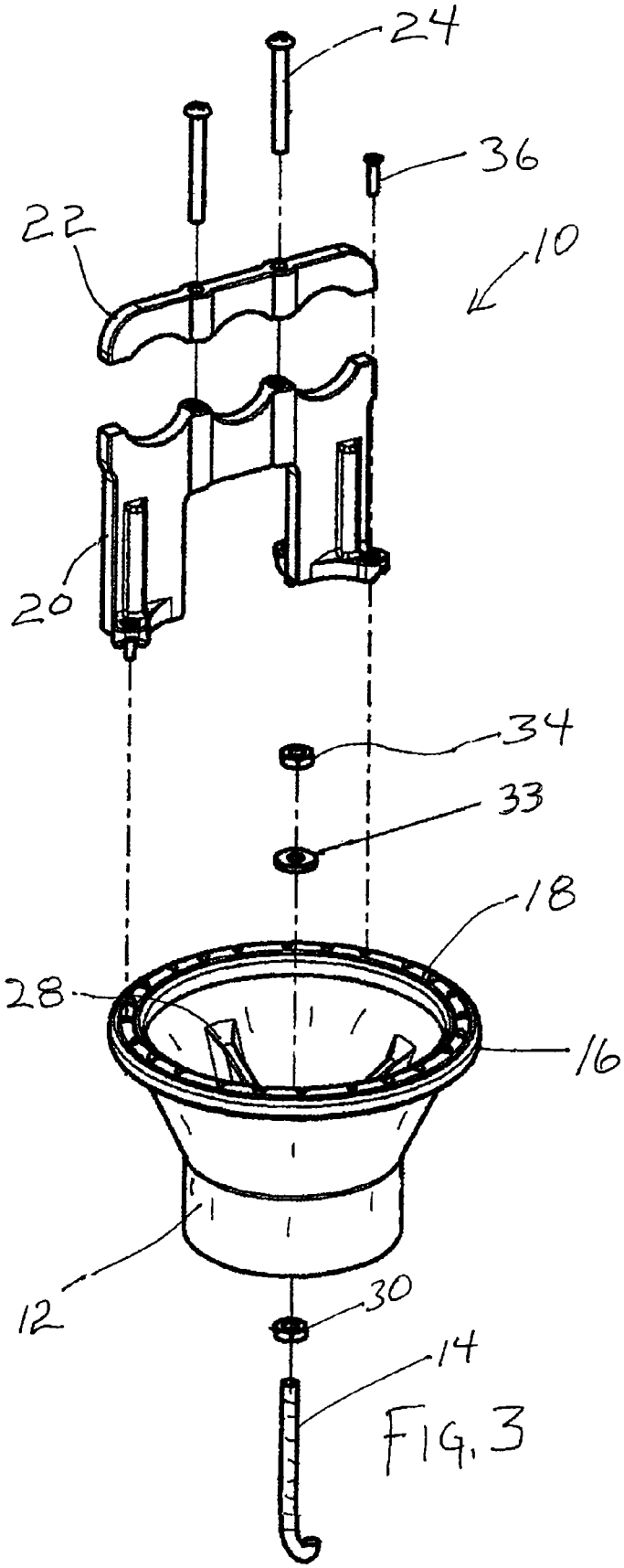
FIG. 3 is an exploded perspective view of a backflow prevention device according to an embodiment of the present invention.
Figure 4:
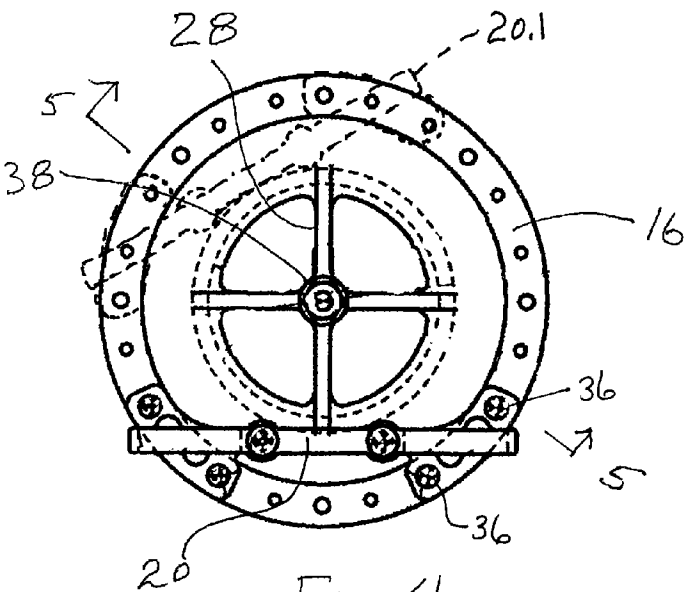
FIG. 4 is a top plan view of a backflow prevention device according to an embodiment of the present invention.
Figure 5:
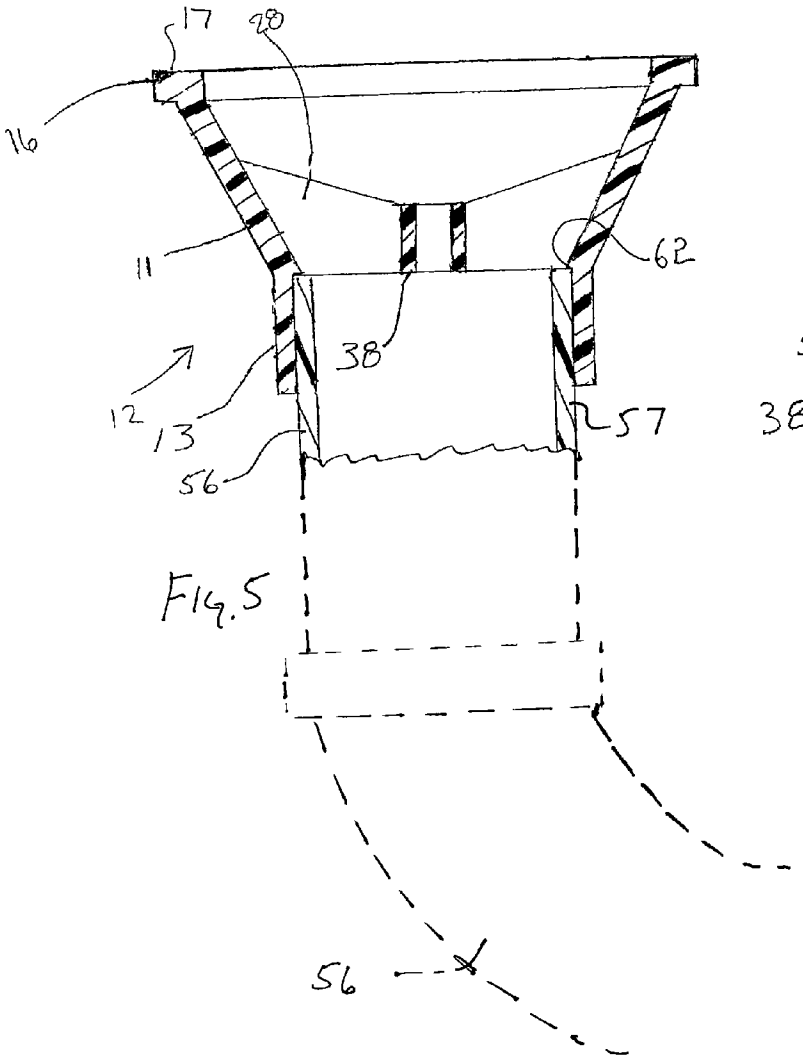
FIG. 5 is a cross sectional view of the drainage hub portion of the device of FIG. 4 bonded to a standard plumbing pipe and taken at line 5-5 of FIG. 4.

Referring to FIGS. 1 through 5, a backflow prevention device 10 generally comprises a drainage hub 12, a tubing mount 20 and a fastening device 14. Drainage hub 12 may consist of a funnel shaped portion 11 and a lower pipe portion 13. Drainage hub 12 is generally connected to a drain or pipe as shown in FIG. 2 or FIG. 5. This connection may be accomplished in one of two ways. Drainage hub 12 can be directly connected to a drain or sewer cover through the use of a fastening device 14 such as a J-shaped hook. Installation of device 10 may also occur through lower portion 13 being conventionally bonded to the sewer or drain system such as by use of solvent welding, adhesives, threads, or the like.

Drainage hub 12 has a flange with an upper rim 16 having a mounting surface 17, to which tube mount 20 is attached. The body of drainage hub 12 has a central opening 26 that runs from upper rim 16 through lower portion 13 that defines a liquid flow conduit. Upper rim 16 preferably has holes 18 that can be used to attach tube mount 20 to drainage hub 12 using conventional means such as a nuts and bolts or self tapping screws. Alternate sizes of holes may be provided. The plurality of holes 18 allows for the attachment of a plurality of tube mounts 20 and allows adjustability in positioning of the tube mount 20 or mounts around the mounting surface 17. Thus, an advantage and feature is that the device can be used with a plurality of discharge drain lines 32 as well as discharge lines coming from different directions, and tube mount 20 can be positioned or repositioned to better fit within a given space after drainage hub 12 has been attached to the sewer system.

Tube mount 20 has a base 21 and cap portion 22 and allows for the easy installation of backflow prevention device 10 for use with multiple drain lines. The upper edge of tube mount base 21 can have U-shaped indents or slots to cradle and support multiple drain lines at once as shown in FIG. 2 with drain line 32. Tube mount 20 supports drain lines above central opening 26. Mount cap portion 22 in conjunction with fasteners, such as screws or nuts and bolts, are used to clamp the drain lines 32 in place. Mount cap 22 can also have indentations on its lower edge mirroring those on the upper edge of tube mount base 21. Together the indents on mount cap 22 and mount base 21 cooperate to secure drain discharge lines so that they can discharge into drainage hub 12 of backflow prevention device 10. Fastener 24 is used to hold mount cap 22 securely connected to mount base 21. Fastener 24 is preferably a screw or a nut and bolt combination. The use of a nut and bolt or similar device for fastener 24 to connect mount cap 22 and mount base 21 allows device 10 to be used with drain tubes of varying sizes without the need to substitute pieces. Tube mount 20 maintains a spaced relationship between the drain lines 32 discharging into drainage hub 12. The height selected for tube mount 20 determines the preset vertical air gap G between drain lines 32 and drainage hub 12. Other attachment methods may be used to secure the tubing mount to the drainage hub flange. For example C-shaped clamping structure could snap onto cooperating structure on the rim eliminating the need for screws. Attachment pegs with interference fits and resilient pieces could be integral with the tube mount to be inserted into apertures on the hub flange.

The drainage hub 12 and the tube mount 20 can preferably be formed through injection molding. They are typically formed of an inexpensive plastic useful in plumbing applications, such as polyvinylchloride (PVC). Use of this type of material permits the device to be adhesively, or otherwise liquid tightly connected to the sewer system. Alternatively, drainage hub 12 and tube mount 20 can be formed using any other plastic molding process and can be formed of any other plastic material.

Grate fastening device 14 can be attached to backflow prevention device 10 though webbing or cross supports 28. Cross supports 28 are integrally formed with drainage hub 12 during injection molding of drainage hub 12. A boss 38 is supported by the webbing and has an aperture to permit a threaded J-hook to extend therethrough. The threaded J-hook may be hooked onto a grating 50 of a floor drain 52, as illustrated in FIG. 2.

A drain discharge line 32 is illustrated in FIG. 2 with the tube mount 20 to form a preset vertical gap G between the discharge drain lines 32 and the drainage hub 12. To facilitate escape of sewer waste in the event backflow occurs, air gap G extends substantially around the circumferential extent of upper rim 16 of drainage hub 12. In the preferred embodiment, tube mount 20 has two legs with an opening in between to provide an overflow volume which is circumferentially as large as possible while maintaining the ability to support multiple discharge lines.

FIG. 3 is an exploded view of backflow prevention device 10. Nuts 30 and 34 along with washer 33 can be used such that fastening device 14 attaches backflow prevention device 10 to a drain grid without the removal of the drain grid and without risking the loss of fastening device 14 by dropping it through the drain grid. Nuts 30, 34 can be loosened enough that fastening device 14 can be maneuvered through the grids of the drain, but not so loose that it can separate completely from drainage hub 12 and fall into the sewer system. After the fastening device 14 has been threaded below the grid, nuts 30, 34 are tightened until lower end 13 of the drainage hub 12 and the sewer grate are secured together.

FIG. 4 is a top down view of drainage hub 12 showing the configuration of the cross supports 28 configured as flutes or webbing. Boss 38 can be positioned at the intersection of the two such cross supports 28. Screws 36 can be used to attach the tube mount 20 to the upper rim 16. The use of a screw 36 or other non-permanent fastening system allows for the flexibility to reposition the tube mount 20 with ease to better fit in the specific location. Moreover, the flange and upper rim with aperatures extending all the way around the rim allows additional tube mounts 20.1 to be attached. Thus drain tubing coming from different directions can be easily accommodated.

FIG. 5 is a cross-sectional view of drainage hub 12 cut along line 5-5 of FIG. 4. The figure shows the location of cross support 28, above the portion of drainage hub 12 pipe portion 13. The lower portion 13 of drainage hub 12 has a diameter sized such that drainage hub 12 can be attached, through means such as conventional bonding, to a standard pipe for example on a drain stand 56. J-shaped hook 14 may be removed in such an application. The drain pipe nipple 57 may engage an inside diameter and abut a shoulder 62 within the fixture. The inside diameter is sized to conform to standardized PVC pipe. For example it may be sized at 2.39 inches to fit on standard 2 inch pipe having an outside diameter of 2.375 inches.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered by the spirit and technical theory of the subject invention.

The invention claimed is:

1. A method of manufacturing a device for preventing back flow from a drain into drain lines, comprising:

injection molding a drainage hub comprising an upper funnel portion and a lower pipe portion that define a liquid flow conduit for discharging liquid from a plurality of drain lines through the drainage hub, the upper funnel portion including a flange having an upwardly facing mounting surface; and injection molding a tube mount selectively attachable to the drainage hub on the mounting surface, the tube mount including a mount base and a mount cap defining a plurality of drain line mounts configured to secure the plurality of drain lines in a vertically displaced position from the drainage hub when the tube mount is attached to the drainage hub.

2. A method of preventing backflow from a drain into drain lines, comprising:

fluidly connecting a drainage hub comprising an upper funnel portion and a lower pipe portion that define a liquid flow conduit for discharging liquid from a plurality of drain lines through the drainage hub to a drain;

connecting a tube mount to an upwardly facing mounting surface of a flange disposed on the drainage hub; and securing a plurality of drain lines to a plurality of drain line mounts on the tube mount such that the drain lines are configured to drain into the drainage hub and such that there is a vertical gap between each drain line and the drainage hub.

3. The method of claim 2, wherein the upwardly facing mounting surface includes a plurality of apertures, and connecting the tube mount to the upwardly facing mounting surface includes selectively positioning the tube mount around the mounting surface by inserting fasteners through the tube mount and into selected apertures.

4. The method of claim 2, wherein the drainage hub includes a fastening device, and wherein fluidly connecting a drainage hub to a drain includes attaching the fastening device to a portion of the drain.

5. The method of claim 2, wherein fluidly connecting a drainage hub to a drain includes one of the group consisting of: welding, adhesive bonding, or threading.

6. The method of claim 2, further comprising:

connecting a second tube mount to the upwardly facing mounting surface;

securing a plurality of drain lines to a plurality of drain line mounts on the second tube mount such that the drain lines are configured to drain into the drainage hub and such that there is a vertical gap between each drain line and the drainage hub.

7. The method of claim 2, further comprising:

disconnecting the tube mount from the upwardly facing mounting surface; and connecting the tube mount at a different location on the upwardly facing mounting surface.

8. The method of claim 2, wherein the tube mount includes a mount base and a mount cap and the drain line mounts are defined between the mount base and the mount cap, and wherein securing a plurality of drain lines to a plurality of drain line mounts includes inserting the drain lines into the drain line mounts and lowering the mount cap with respect to the mount base to secure the drain lines.

9. The method of claim 8, wherein lowering the mount cap with respect to the mount base includes rotating one or more fasteners connecting the mount cap and the mount base.

10. A device for preventing back flow from a drain into drain discharge lines, comprising:

a drainage hub comprising an upper funnel portion and a lower pipe portion that define a liquid flow conduit for discharging liquid from a plurality of drain lines through the drainage hub, the upper funnel portion including a flange having an upwardly facing mounting surface;

a tube mount selectively attached to the drainage hub on the mounting surface, the tube mount comprising a mount base having a plurality of u-shaped slots defining a plurality of drain line mounts configured to secure the plurality of drain lines in a vertically displaced position from the drainage hub.

11. The device of claim 10, wherein the mounting surface includes a plurality of apertures and the tube mount is selectively positionable around the mounting surface by inserting fasteners through the tube mount and into selected apertures.

12. The device of claim 10, wherein the mount base includes a pair of legs that attach to the drainage hub with an opening there between.

13. The device of claim 10, further comprising a mount cap, wherein the mount cap is selectively connected to and selectively vertically positionable relative to the mount base with fasteners extending between the mount cap and the mount base, and wherein the tube mount is configured to secure the drain lines within the drain line mounts by vertically positioning the mount cap closer to the mount base.

14. The device of claim 2, further comprising a second tube mount selectively attached to the drainage hub on the mounting surface, the second tube mount also including a mount base and a mount cap defining a plurality of drain line mounts configured to secure drain lines in a vertically displaced position from the drainage hub.

15. The device of claim 10, wherein the drainage hub further comprises means for connecting the drainage hub to a drain.

16. The device of claim 4, wherein the means for connecting is attached to the drainage hub with a central boss supported within the lower pipe portion by a plurality of cross supports.

* * * * *